United States Patent [19]

Hosono et al.

[11] 4,104,996

[45] Aug. 8, 1978

[54] GAP SELF-COMPENSATING HYDRAULIC ROCKER ARM

[75] Inventors: Akira Hosono, Toyota; Yoshihisa Isogai, Okazaki; Hitoshi Hasegawa, Nagoya; Toshio Tanahashi, Toyota, all of Japan

[73] Assignee: Toyota Jidosha Kogyo Kabushiki Kaisha, Toyota, Japan

[21] Appl. No.: 732,323

[22] Filed: Oct. 14, 1976

[30] Foreign Application Priority Data

Aug. 10, 1976 [JP] Japan ..... 51-94526

[51] Int. Cl.[2] ..... F01L 1/18; F01L 1/24

[52] U.S. Cl. ..... 123/90.43; 123/90.36; 123/90.46; 123/90.47

[58] Field of Search ..... 123/90.36, 90.43, 90.46, 123/90.47

[56] References Cited

U.S. PATENT DOCUMENTS

| | | | |
|---|---|---|---|
| 2,808,818 | 10/1957 | Sampietro | 123/90.43 |
| 2,871,838 | 2/1959 | Dadd | 123/90.43 |
| 3,314,404 | 4/1967 | Thompson | 123/90.43 |
| 3,716,036 | 2/1973 | Kruger | 123/90.46 |
| 3,875,908 | 4/1975 | Ayres | 123/90.46 |

*Primary Examiner*—Charles J. Myhre
*Assistant Examiner*—Sheldon Richter

[57] ABSTRACT

A gap self-compensating valving mechanism for an internal combustion engine, provided with a hydraulic pressure retaining mechanism arranged in place between a rocker shaft and a rocker arm. The hydraulic pressure containing mechanism including lifters, a check valve and a return spring.

7 Claims, 5 Drawing Figures

GAP SELF-COMPENSATING HYDRAULIC ROCKER ARM

BACKGROUND OF THE INVENTION

The present invention relates generally to a valving mechanism for an internal combustion engine and, more specifically, to a gap self-compensating hydraulic rocker arm.

In an internal combustion engine, the motion of a valve generally exerts a great influence upon the volumetric efficiency, the noise of the engine, and the durability of the valve; and whether or not a valving mechanism is designed in a proper manner influences the performance, the economy, and the durability of the engine.

As the number of revolutions of an engine increases, the inertia force of a valving mechanism increases, until the whirling motion of a valve rises, the regulating time of the valve is rendered irregular, and the suctioning efficiency of the valve deteriorates, which results in deterioration in the performance of the engine and an increase in the seating sound of the valve, to thus increase not only the noise of but also stress on the valve, until the valve breaks as a result of fatigue.

Furthermore, at least one part of the valving mechanism, is subjected to thermal deformation at the time of the operation of the engine in correspondence to the state thereof. For preventing the valve from being kept open by thermal expansion of the valving mechanism, the linkage mechanism of the valving mechanism is provided with appropriate clearances. Excessive clearance of the valve causes the air-tightness of the valve to be rendered defective in the course of the operation thereof. An oil lifter is what is specifically employed for assuring automatic control of this clearance.

In the conventional valving mechanism provided with a rocker shaft and a rocker arm, an automatic control mechanism having a large quantity of oil contained therein, hence being large in mass, is arranged at the top of the rocker arm at a position that is spaced far apart from the center of the rocker shaft. Therefore, the inertia mass of the moving part thereof becomes extremely large, which constitutes a problem in terms of reducing the maximum number of revolutions and decreasing the durability of an internal combustion engine.

SUMMARY OF THE INVENTION

An object of the present invention is to provide an automatic control type hydraulic rocker arm that is capable of minimizing the above-mentioned irregularities with requiring a large scale modification of the valving mechanism presently in use.

Another object of the present invention is to provide an automatic control type hydraulic rocker arm wherein the inertia mass is substantially reduced, compared with the conventional valving mechanism, whereby a high level of efficiency and reliable actuation can be attained.

Still other objects, features, and advantages of the present invention will appear more fully through the following description.

DETAILED DESCRIPTION OF THE INVENTION

Figure 1:
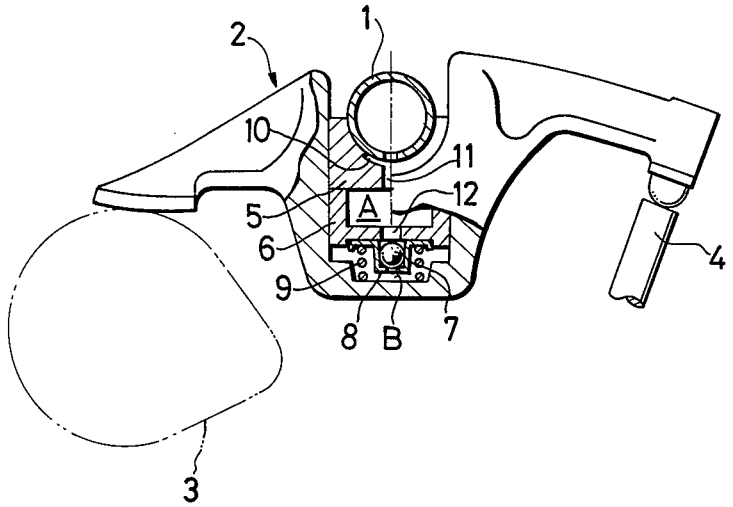
FIG. 1 is a side elevational view partially in section of one embodiment of the automatic control type rocker arm according to the present invention.
Figure 2:
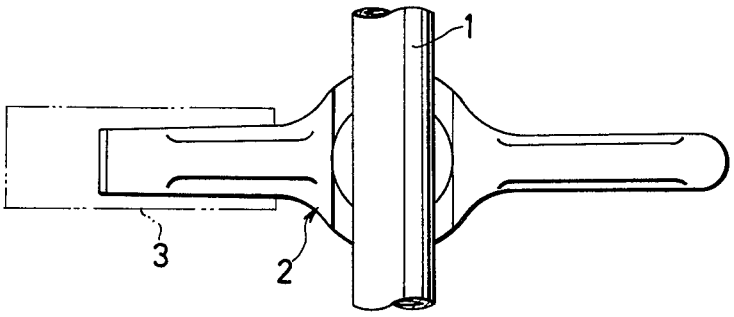
FIG. 2 is a plan view of the assembly of the rocker arm shown in FIG. 1.

The rocker arm will be described in detail with regard to the construction and the function thereof, by making reference to FIG. 1 of the drawings attached thereto.

As may be seen in the drawing, the rocker arm 2 is provided with a centrally located having a bottom wall. The central bore hole has a return spring 9, a ball socket 8, a ball 7, a second lifter 6 and a first lifter 5 assembled therein. A semicircular concave recess formed on the top surface of the first lifter 5 conforms with the outer diameter of a rocker shaft 1, which is supported thereby in a rotating manner. One end of the rocker arm 2 is in contact with a cam 3A valve stem 4 is in contact with the other end of the rocker arm 2.

The rocker shaft 1 has pressurized oil fed therein from an oil pump (not shown in the drawing), the oil running into the chamber A formed on the second lifter 6 from an oil aperture formed on the bottom of the rocker shaft by way of an oil groove 10 formed on the bottom of the semicircular concave recess on the first lifter 5 and then by way of an oil passage 11 in the first lifter 5. Thereafter the oil runs through an oil passage 12 formed on the bottom of the second lifter 6, releases the ball 7 from its seat by displacing the ball socket 8 agains the force of the spring 9. The oil, fills the hydraulic chamber B formed by the second lifter 6 and the bottom inner surface of the rocker arm, and the both chambers A, B are balanced in terms of the hydraulic pressure therein.

When the valve clearance occurs in the valving mechanism in this state, the second lifter 6 immediately arises due to the force of the return spring 9, the volume of the hydraulic chamber B is expanded, and the pressure in the hydraulic chamber B is lowered. Therefore, the pressurized oil in the chamber A runs into the chamber B by way of the oil passage 12 by displacing the ball 7, and the pressure becomes balanced. Thereby the clearance is automatically controlled and compensated.

When the camshaft 3 rotates and the cam crest is going to push up one end of the rocker arm 2, the rocker arm 2 first applies a force that will lift the rocker shaft 1, with the valve stem 4 acting as a fulcrum and in this case, the ball 7 closes the oil passage 12 to thereby retained the hydraulic pressure in the hydraulic pressure chamber B. Therefore the rocker shaft 1 is kept from being lifted and the rocker arm 2 pushes the valve stem 4 downward, with the rocker shaft 1 acting as a fulcrum. As the camshaft 3 rotates in the direction of the cam crest, the rocker arm 2 also rotates around the rocker shaft 1 by way of the first lifter 5. When the return spring 9 expands, the ball 7 closes the oil passage 12 by constant pressure at all times, whereby the time lag of the rise in hydraulic pressure in the hydraulic pressure chamber B can be prevented.

The first lifter 5 and the second lifter 6 employed in this invention are both required to be made of heat-resistant, oil-resistant and wear-resistant material.

In general practice, when some of the rocker arms are positioned on the cam crest at the time the engine is stopped, for instance, the quantity of oil in the chamber B is reduced by leakage of oil out of the said chamber during the period that the engine is stopped, the chamber B is subjected to a reduction in volume. The rocker arm 2 travels upward in relation to the lifters 5 and 6. The contact force of both butt end surfaces of the rocker arm 2 with the cam surface and the valve stem 4, respectively, is reduced, and, when the rocker arm 2 is started again in that state, the force to push the valve stem 4 is lost at the time the cam is descending from the cam crest. Play is produced in the rocker arm 2, until such play causes the noise in the valving mechanism. Furthermore, time is required for feeding the rocker shaft 1 with high-pressure oil at the time is started the engine. Therefore, feeding the hydraulic pressure chamber B with the pressurized oil in a conforming manner cannot be expected. The reason for employing a divided lifter 5 provided with the chamber A as is shown in the drawing, in the case of the present invention lies in meeting the requirement of eliminating the above-mentioned irregularities and disadvantages; therefore, it is desirable and recommendable that the chamber A be allowed a sufficient space for the pressurized oil well in excess of the volume to fill the chamber B, that the first lifter 5 be prevented from bottoming against the chamber B, that the degree of upward travel of the rocker arm 2 be limited, and that a stepped bottom be formed for the purpose of protecting the spring 9.

Figure 3:
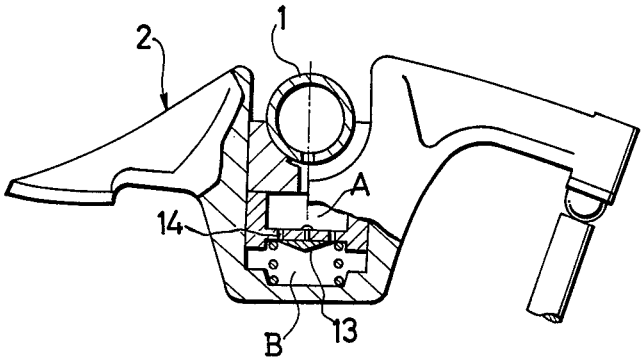
FIG. 3 is a side elevational view partially in section illustrating another embodiment of the rocker arm according to the present invention and having a different kind of check valve positioned thereon.
Figure 4:
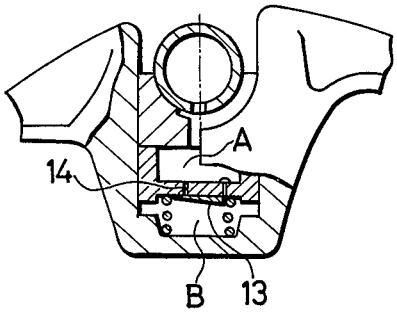
FIG. 4 is a fragmentary side elevational view partially in section illustrating a modification of the embodiment shown in FIG. 3.
Figure 5:
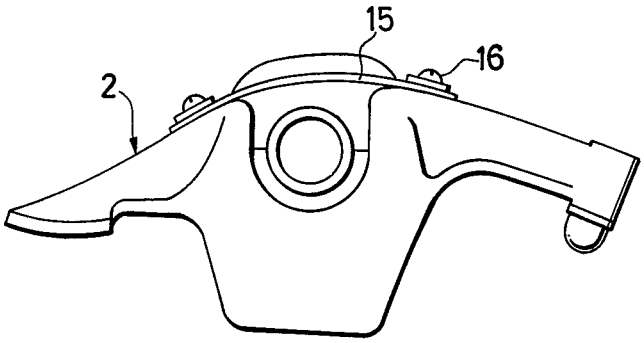
FIG. 5 is a side elevational view illustrating a rocker arm according to the present invention that is reinforced by an overlaid stiffener.

The rocker arm 2 fitted with the check ball type check valve shown in FIG. 1 is as described above. A check valve that comprises a combination of one or more orifices in combination with a valve plate made of heat-resistant, wear-resistant, and oil-resistant flexible material, in a manner shown in FIG. 3 and FIG. 4 can also be employed. Furthermore, with regard to the rocker arm 2, an overlaid stiffener 15 can be arranged in place spanning the right and left section by means of such as set screws 16, as shown in FIG. 5, wherever so required.

Though the lifters described above have been shown as a combined type, it is clear that it may be formed in a single unit as long as it includes an oil chamber having a sufficient space for the oil well therewithin.

The description of the present invention is given in the preceding paragraphs with regard to such a valving mechanism of the overhead type as is employed in the illustration shown in the drawing; however, the statement given above is not defining but inclusive in the applicability of the present invention to a valving mechanism of the push-rod type, as the matter is clear amd evident enough.

What is claimed is:

1. A gap self-compensating hydraulic rocker arm assembly for an internal combustion engine having a rocker shaft, at least one hollow rocker arm having oil passage means through the wall thereof and a valving mechanism comprising a hydraulic pressure retaining mechanism including lifter means said lifter means contacting said rocker shaft, said lifter means having a first oil chamber in fluid communication with the interior of the rocker arm, a second oil chamber located between said lifter means and a portion of the rocker arm, said second oil chamber being capable of being placed in fluid communication with said first oil chamber, a check valve in said second oil chamber for controlling the flow of oil between said first and said second oil chambers, and a return spring positioned in said second oil chamber between said lifter means and a portion of the rocker arm.

2. The gap self-compensating hydraulic rocker arm assembly set forth in claim 1 wherein the said check valve is of the check ball type.

3. The gap self-compensating hydraulic rocker arm assembly set forth in claim 1 wherein the said check valve is of one or more orifices and a flexible valve plate type.

4. The gap self-compensating hydraulic rocker arm assembly set forth in claim 1 wherein there is further included a stiffener plate secured to the upper portion of the the rocker arm in overlaying relationship with the rocker shaft.

5. The gap self-compensating hydraulic rocker arm assembly set forth in claim 1 wherein said lifter means comprises a first section having an oil passage therethrough for providing fluid communication between the interior of the rocker arm and said first oil chamber and a second section having an oil passage therethrough for providing fluid communication between said first oil chamber and said second oil chamber.

6. The gap self-compensating hydraulic rocker arm assembly set forth in claim 5 wherein said portion of the rocker arm includes a recess for receiving one end of said returne spring, said recess being bounded by a peripheral edge that defines means for limiting movement of said second section of said lifter means in a direction away from said first section of said lifter means.

7. The gap self-compensating hydraulic rocker arm assembly set forth in claim 5 wherein said check valve ball is captured in a cup-shaped socket having a base wall with an opening therethrough and a flange extending laterally from the end of said socket opposite said base wall, one end of said return spring being positioned against said flange for urging said socket against said second section of said lifter means.

* * * * *